US010299654B2

(12) United States Patent
Rawet

(10) Patent No.: US 10,299,654 B2
(45) Date of Patent: May 28, 2019

(54) FLUID SUCTION DEVICE

(71) Applicant: Eric Rawet, Boca Raton, FL (US)

(72) Inventor: Eric Rawet, Boca Raton, FL (US)

( * ) Notice: Subject to any disclaimer, the term of this patent is extended or adjusted under 35 U.S.C. 154(b) by 27 days.

(21) Appl. No.: 15/268,712

(22) Filed: Sep. 19, 2016

(65) Prior Publication Data

US 2017/0215674 A1 Aug. 3, 2017

Related U.S. Application Data

(60) Provisional application No. 62/388,568, filed on Feb. 2, 2016.

(51) Int. Cl.

| | |
|---|---|
| ***A47L 11/30*** | (2006.01) |
| ***A47L 11/40*** | (2006.01) |
| ***E01H 1/10*** | (2006.01) |

(52) U.S. Cl.

CPC ..... *A47L 11/4091* (2013.01); *A47L 11/4005* (2013.01); *A47L 11/4008* (2013.01); *A47L 11/4016* (2013.01); *A47L 11/4041* (2013.01); *A47L 11/4044* (2013.01); *A47L 11/4075* (2013.01); *A47L 11/4083* (2013.01); *A47L 11/4088* (2013.01); *E01H 1/103* (2013.01)

(58) Field of Classification Search

CPC ..... A47L 11/4005; A47L 11/4008; A47L 11/4016; A47L 11/4041; A47L 11/4044; A47L 11/4075; A47L 11/4083; A47L 11/4088; A47L 11/4091; E01H 1/103

See application file for complete search history.

(56) References Cited

U.S. PATENT DOCUMENTS

| | | | | |
|---|---|---|---|---|
| 1,992,986 A * | 3/1935 | Bender | A47L 11/30 | 15/339 |
| 3,520,300 A * | 7/1970 | Flower, Jr. | A61M 1/008 | 433/91 |
| 5,437,651 A * | 8/1995 | Todd | A61M 1/0088 | 15/420 |
| 5,628,735 A * | 5/1997 | Skow | A61F 13/38 | 604/268 |
| 5,655,258 A * | 8/1997 | Heintz | A47L 7/0009 | 15/415.1 |

(Continued)

FOREIGN PATENT DOCUMENTS

DE 4117957 A1 * 12/1992 ..... A47L 11/30

OTHER PUBLICATIONS

DE 4117957 A1—Dec. 1992—English Machine Translation.*

*Primary Examiner* — Marc Carlson
(74) *Attorney, Agent, or Firm* — Allen F. Bennett; Bennett Intellectual Property

(57) ABSTRACT

A fluid suction device includes an elongate handle having a suction head at its distal end. The suction head extends in opposing directions substantially perpendicularly to the handle. The suction head includes an elongate longitudinal aperture in its outer wall in fluid communication with a suction pump. An absorbent panel covers the longitudinal aperture. When the suction head is applied to a spilled fluid, the wicking action of the absorbent panel and the negative air pressure from the suction pump allows rapid and efficient cleaning of an area affected by a fluid spill. The device also allows for safe and efficient removal of potentially dangerous objects such as broken glass. The device collects fluid in a waste reservoir so that it is easily disposed of.

8 Claims, 4 Drawing Sheets

(56) References Cited

U.S. PATENT DOCUMENTS 6,080,243 A * 6/2000 Insley ..... A47L 9/02 134/21
6,136,098 A * 10/2000 Tribastone ..... A47L 7/0009 134/21
7,979,952 B2 * 7/2011 Beskow ..... A47L 9/04 15/322
8,939,951 B1 * 1/2015 Getsay ..... A61M 1/008 604/319
9,351,622 B2 * 5/2016 Bruders ..... A47L 11/4044
9,814,365 B2 * 11/2017 Conrad ..... A47L 13/225
2002/0026683 A1 * 3/2002 Kasper ..... A47L 5/30 15/320
2008/0078042 A1 * 4/2008 Cook ..... A47L 11/26 15/98
2008/0148512 A1 * 6/2008 Beskow ..... A47L 9/04 15/350
2011/0131753 A1 * 6/2011 Krebs ..... A47L 11/4036 15/320
2012/0222227 A1 * 9/2012 Johnson ..... A47L 11/4002 15/105
2013/0180547 A1 * 7/2013 Kent ..... A47L 11/282 134/6
2013/0232713 A1 * 9/2013 Luedke ..... A47L 13/225 15/228
2013/0327353 A1 * 12/2013 Field ..... A47L 11/4083 134/1
2014/0259478 A1 * 9/2014 Conrad ..... A47L 11/4083 15/98
2014/0259510 A1 * 9/2014 Conrad ..... A47L 13/225 15/319
2015/0250367 A1 * 9/2015 Van Der Kooi ..... A47L 9/0477 15/364
2017/0119225 A1 * 5/2017 Xia ..... A47L 11/302
2017/0127903 A1 * 5/2017 Grandstrand ..... A47L 13/225
2017/0215676 A1 * 8/2017 Moser ..... A47L 11/302

* cited by examiner

FLUID SUCTION DEVICE

CROSS-REFERENCE TO RELATED APPLICATIONS

This application claims priority to U.S. Provisional Application Ser. No. 62/388,568 filed on Feb. 2, 2016, the contents of which are hereby incorporated in their entirety.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable

REFERENCE TO SEQUENCE LISTING, A TABLE, OR A COMPUTER PROGRAM LISTING APPENDIX SUBMITTED ON A COMPACT DISC AND INCORPORATION-BY-REFERENCE OF THE MATERIAL

Not Applicable.

COPYRIGHT NOTICE

Not Applicable

BACKGROUND OF THE INVENTION

Field of the Invention

The present invention relates to devices, systems and methods for effectively and sanitarily removing liquids from a surface. More particularly, the invention relates to devices, systems and methods for removing spilled or other liquids off a surface in a quick and efficient method using a device that wicks liquid through an absorbent panel.

Description of the Related Art

Fluids often leak from containers when dropped in grocery stores. During medical procedures bio-hazardous fluids accumulate on floor often causing slip and fall accidents, cross contamination, electrocution or bio-hazardous contact. Generally, standing water, chemical spills, biohazardous or unsanitary fluids on floors decrease the level of safety for all involved.

Known apparatuses and methods for removing fluid include mops, buckets, wringers and dry/wet vacuums which pose numerous disadvantages. For one, the task of mopping, rinsing and wringing, when removing standing fluids is inefficient due to the poor absorption and spread of liquid to a larger area. Mops become heavy and difficult to maneuver, and may cause back injury due to weight and side to side motion by user. They are also typically unsuitable for drying a surface while cleaning a liquid spill simultaneously. They are also typically unhygienic and an efficient for use in an environment where microorganisms are undesirable.

Additionally, the volume of water and cleaning solutions used to mop floors cannot be regulated efficiently and must air dry for approximately 10-15 minutes and If not dry when walked on slip and fall injuries occur. By way of further example, mops, wringers, buckets and wet vacuums are problematic to keep clean and can easily become unsanitary preventing safe re-use unless rinsed and sanitized after each use.

Squeegees have also been modified to include suction conduits on or near the squeegee. Other devices include steamers that both dispense water and suck it back up. They are typically cumbersome and do not adequately remove liquid. More common wet/dry vacuums are also cumbersome and typically utilize suction from an open nozzle to remove liquid.

The above-described deficiencies of today's systems are merely intended to provide an overview of some of the problems of conventional systems, and are not intended to be exhaustive. Other problems with the state of the art and corresponding benefits of some of the various non-limiting embodiments may become further apparent upon review of the following detailed description.

BRIEF SUMMARY OF THE INVENTION

Disclosed is a fluid suction apparatus and related methods. According to an embodiment of the present invention, the suction apparatus may include a fluid absorbing device, such as a suction head. The suction head may comprise a pipe with a plurality of holes or a single slot therein that is in fluid communication with pipe and is covered by a removable fluid-absorbent cover such as micro fiber which causes a constant wicking effect. The pipe is fluidly connected to a flexible tube by a 90 degree barbed connector on one of its ends and is capped on the other to prevent loss suction. The pipe can be of varying length to accommodate a larger or smaller floor space and maneuverability concerns. The holes or slot can also be of varying sizes to accommodate a greater volume of fluid intake. The pipe is attached by screw to a jointed stem that can swivel left or right to increase maneuverability and is attached by screws to a handle of varying length.

When attaching pipe and stem to handle it may be used in a mop like manner. The handle may be adjustable in length and capable of accommodating different heights of users, as well as detachable such that the suction head can be used by hand replacing handle.

The opposite end of tube coming from suction head up handle is attached to an intake port of alternating or direct current electrically driven self priming pump. Suction pump is able to run electrically by means of a rechargeable battery giving device full portability indoors and outdoors or power can draw by plugging its power cord directly into a 120V receptacle. The pump, waste reservoir and battery can be attached permanently to either a bucket, platform, carry case or any shaped fabricated encasement. Wheels can be screwed under any of the above and or a harness can be attached to wear as a back pack.

A varying sized or shaped reservoir may be used. Reservoir being filled by way of fluid on floor in direct contact with micro fiber into suction head, through a varying length of flexible tubing into pump intake, pumped out exhaust and through tube attached to reservoir which can be detached to pour contents into sink, toilet or drain, or incinerated then reattached to tube for continued use. Buckets are heavy, cumbersome and must be emptied by lifting over sink or tilting over drain causing possible back injuries.

Separate container of cleaning fluid may be attached to handle allowing user to spray onto floor and immediately suck through suction head. Freshly sprayed cleaning solution being evacuated from floor allows effective sanitization. Continually dipping dirty conventional mops into buckets cause weakened strength and contamination of water and cleaning solution.

Eliminating the need to fill a conventional bucket with approximately 32 quarts of water several times a day due to the introduction of a dirty mop contaminating the water within the bucket. With said apparatus water conservation can be achieved. When placing the suction head into a rectangular tray of greater or equal size containing sanitizing liquid and pump activated, sanitizing liquid is sucked through the micro fiber cover into the pipe, through the flexible tube and into pump and into the reservoir sanitizing the entire system.

It is therefore an object of the present invention to provide a fluid suction apparatus and related methods.

Another object of the present invention is to provide a method of spraying a floor with a cleaning solution which traps dirt and bacteria, then removing the solution, dirt and bacteria by evacuating it immediately using a micro fiber cover being continually dried by a suction pump and discharging waste fluid into a reservoir keeping dirty water and cleaning solution from being re-used on floor.

An additional feature of invention is to use an attached suction head to gather glass or other debris into a single pile while simultaneously sucking liquid originating from broken container off floor. Broken glass can be swept up with a brush and pan and disposed of safely. This eliminates removal of glass by use of hands which is the case when using a conventional mop which may spread broken pieces of glass making it a difficult and unsafe task.

These and other objects, aspects and advantages of the present invention will be better appreciated in view of the drawings and following detailed description of preferred embodiments.

There has thus been outlined, rather broadly, the more important features of the invention in order that the detailed description thereof that follows may be better understood, and in order that the present contribution to the art may be better appreciated. There are features of the invention that will be described hereinafter and which will form the subject matter of the claims appended hereto.

BRIEF DESCRIPTION OF THE DRAWINGS

A more complete understanding of the present invention, and the attendant advantages and features thereof, will be more readily understood by reference to the following detailed description when considered in conjunction with the accompanying drawings wherein.

DETAILED DESCRIPTION

Figure 1:
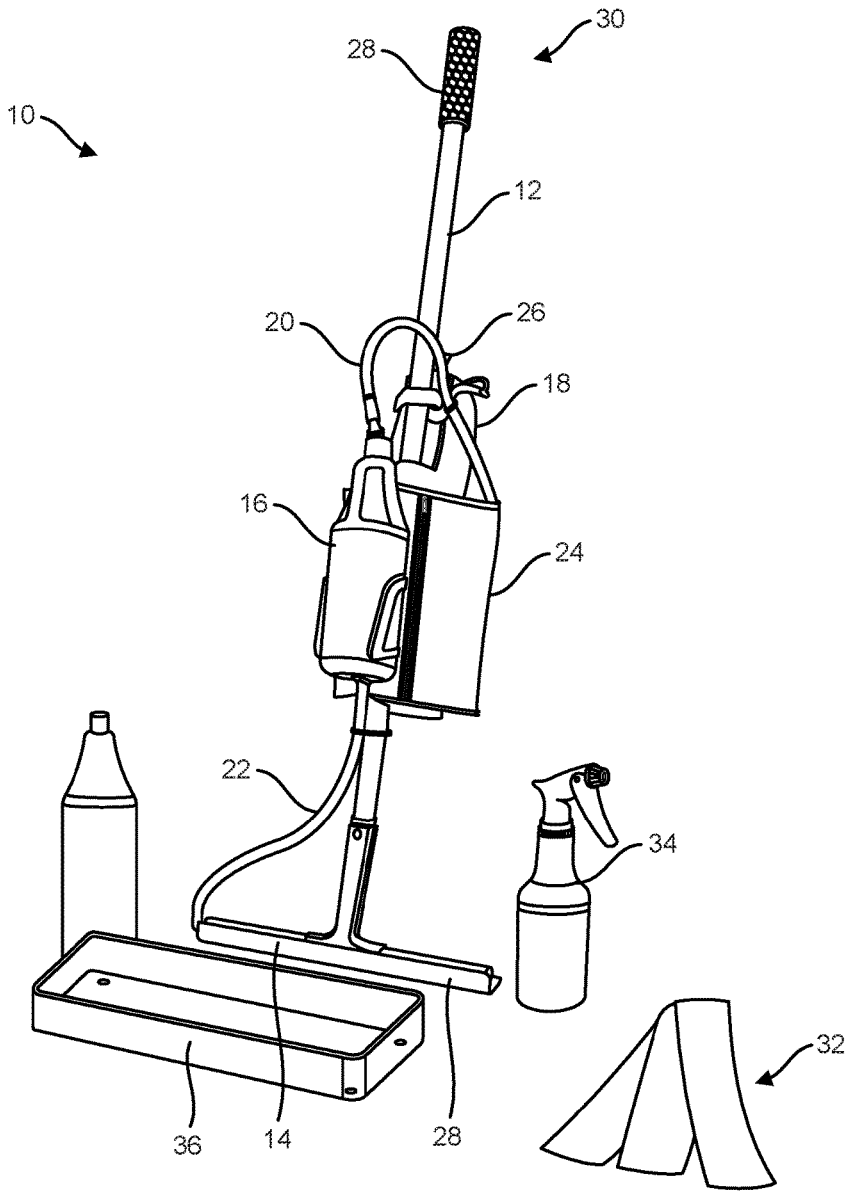
FIG. 1 is a perspective, environmental view of a fluid suction device in accordance with the principles of the invention.

The invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

The disclosed subject matter is described with reference to the drawings, wherein like reference numerals are used to refer to like elements throughout. In the following description, for purposes of explanation, numerous specific details are set forth in order to provide a thorough understanding of the various embodiments of the subject disclosure. It may be evident, however, that the disclosed subject matter may be practiced without these specific details. In other instances, well-known structures and devices are shown in block diagram form in order to facilitate describing the various embodiments herein.

In addition, the term "or" is intended to mean an inclusive "or" rather than an exclusive "or." That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. Moreover, articles "a" and "an" as used in the subject specification and annexed drawings should generally be construed to mean "one or more" unless specified otherwise or clear from context to be directed to a singular form. Throughout the description, the term "downstream" typically refers to a direction equal to the direction of the flow of fluid through a system, and upstream typically refers to a direction opposite, or in reverse to, the flow of fluid through a system.

Disclosed are devices and methods for removing liquids from a surface. In accordance with the principles of the invention, the device may include an elongate body having a handle at a distal end similar to the body and handle of a broom, mop or other devices for acting upon a surface upon which an operator is standing. The distal end of the body has a suction head that extends outward in one or more directions perpendicular to the body. The suction head in one embodiment is substantially cylindrical and includes an internal cavity in fluid communication with the suction heads exterior via one or more apertures covered by an absorbent, wicking panel. The wicking panel may be replaced so that the original panel can be disposed of or cleaned.

The internal cavity of the suction head is also in fluid communication with a suction pump incorporated into the device, usually affixed to the medial region of the elongate body. Typically, fluid communication is provided by a conduit. A waste reservoir is also affixed to the medial region of the elongate body along with a power supply for the suction pump. The waste reservoir collects liquid with through the absorbent panel by the suction applied by the suction pump. The waste reservoir in one embodiment is a vacuum trap positioned on the conduit between the suction head and the suction pump. Optionally, the reservoir may be downstream of the suction pump and the liquid removed from the surface travels through the pump before being dispensed into the waste reservoir. The suction head may optionally be attached to the elongate body by a joint such that the angle of the suction head may be altered. Optionally, the elongate body may be configured to telescopically adjust its length. Optionally, the suction head may be removed and replaced with a suction head having a different configuration.

FIG. 1 shows an embodiment of a fluid suction device 10 in accordance with the principles of the invention. The fluid suction device 10 includes a handle 12, a suction head 14, a waste reservoir 16, and a suction pump 18. The handle 12 is an elongate pole similar to handles of standard brooms, mops, shovels and other handheld tools generally designed for acting upon a surface while an operator stands upon or near the surface being treated. In this embodiment, the suction pump 18 comprises a diaphragm pump. Those skilled in the art will appreciate that there are many types and forms of suction pumps, many of which are suitable for use in the present invention.

The suction pump 18 is in fluid communication with the waste reservoir 16 via a discharge tube 20. The pump 18 is also in fluid communication with the suction head 14 via suction tube 22. The suction head 14 has a substantially cylindrical body and extends in opposite directions perpendicularly from the distal end of the handle 12. In this embodiment, the suction pump 18 creates fluid flow from the suction head 14 to the pump 18 and then into the waste reservoir 16. I.e., the suction pump 18 is downstream from the suction head 14 and the waste reservoir 16 is downstream from the pump 18. Optionally, the waste reservoir 16 may be positioned between the suction head 14 and the pump 18 such that it is downstream from the suction head 14 and upstream of the pump 18.

In the distal region of the suction head 14, i.e. the region of the suction head that is opposite to the direction of the handle 12, is an elongate longitudinally extending aperture, not shown, running along the length of the suction head 14. An absorbent panel 28 is removably affixed to the suction head 14 such that it covers the distal aperture in the suction head 14. A rechargeable battery 24 is also incorporated into this embodiment and supplies power to the suction pump 18. A simple lever switch 26 on the suction pump 18 allows an operator to turn the device on and off. Optionally, the lever switch 26 may be replaced with a power switch that allows an operator to modulate the power supplied to the suction pump 18 in order to adjust the amount of suction applied to the suction head 14. The handle 12 may optionally include a padded sheath 29 at its proximal end 30.

Also shown in FIG. 1 are replacement absorbent panels 32, a spray bottle 34 containing a cleaning liquid, and a tray 36 containing a liquid disinfectant. Absorbent panel 28 may be removed and replaced with one of the panels 32 when the absorbent panel 28 becomes dirty or damaged. The panel 28 may be disposable, recyclable or may be washed and reused. A fluid suction device 10 may optionally include a holster for storing a spray bottle 34. In use, an operator may apply a cleaning fluid in spray bottle 34 to an area to be cleaned. Optionally, the absorbent panel 28 may be dipped into the tray 36, thereby coating it with a disinfectant. The fluid suction device may then be turned on and slowly applied to a spill area. The disinfectant or cleaning fluid may aids in emulsifying or dissolving some types of dirt or other debris and assists in sanitizing the spill area. The suction through the absorbent panel 28 induces a wicking action to quickly and efficiently remove liquid from a spill area. It may be desirable to utilize a microfiber material due to their absorbing and wicking properties.

Figure 2:
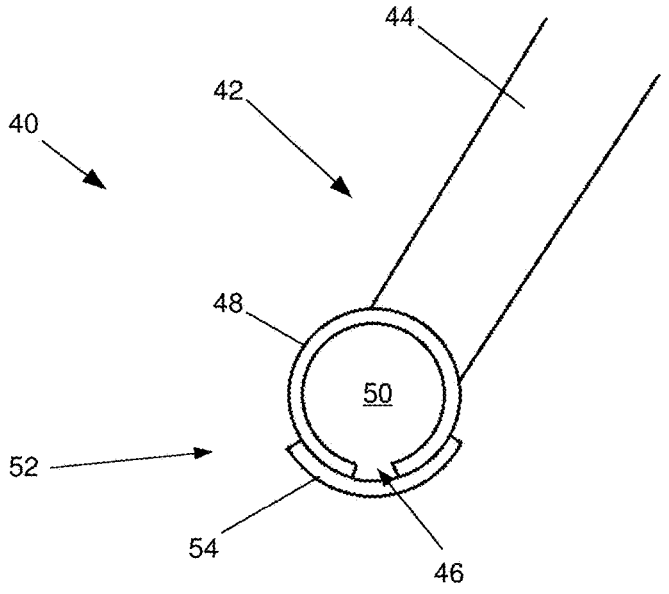
FIG. 2 is a cross-sectional side view of a suction head of a fluid suction device in accordance with the principles of the invention.
Figure 3:
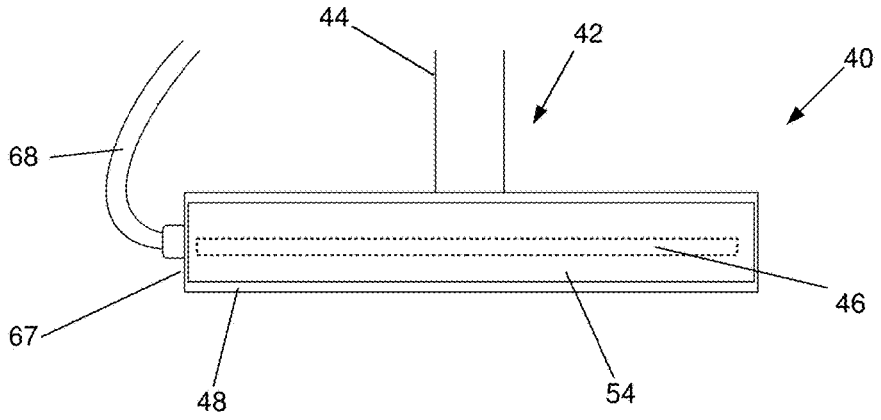
FIG. 3 is a bottom plan view of an alternative embodiment of a suction head of a fluid suction device in accordance with the principles of the invention.

FIG. 2 shows a cutaway side view of a suction head 40 in accordance with the principles of the invention. FIG. 3 shows a bottom view of the suction head shown in FIG. 2. Suction head 40 is positioned at the distal end 42 of a handle 44. In this embodiment, the suction head 40 is tubular, or cylindrical, and includes an aperture 46 in the outer wall 48 and on the distal side 52 of the suction head 40 opposite to the handle 44. The aperture 46 is not positioned exactly 180° away from the handle 44 but is angled to one side. As used herein, the distal side 52 of the suction head 40 is generally defined as the side of the suction head 40 that does not face the handle 44. Optionally, the aperture may be positioned exactly 180° away from the handle 44. The outer wall 48 of the suction head 40 defines an interior compartment 50 that is in fluid communication with a suction pump. An absorbent panel 54 is removably affixed to the outer wall 48 of the section head 40 such that it completely covers the aperture 46. The absorbent panel 54 also extends beyond the aperture 46 around the outer wall 48. In this embodiment, the absorbent panel 54 extends across an arc of approximately 90°. Optionally, the arc over which an absorbent panel extends may range from 360° down to was little as 30°, so long as it covers the aperture 46. In this embodiment, the absorbent panel 54 is removably affixed to the outer wall 48 by complementary hook and loop panels. Optionally, the absorbent panels may be removably affixed to the outer wall by any suitable means, such as for example snaps, buttons, laces, zippers, elastomeric bands, tongue and groove mechanisms and the like. FIG. 3 shows a suction tube 68 attached to one end 67 of the suction head.

Figure 4:
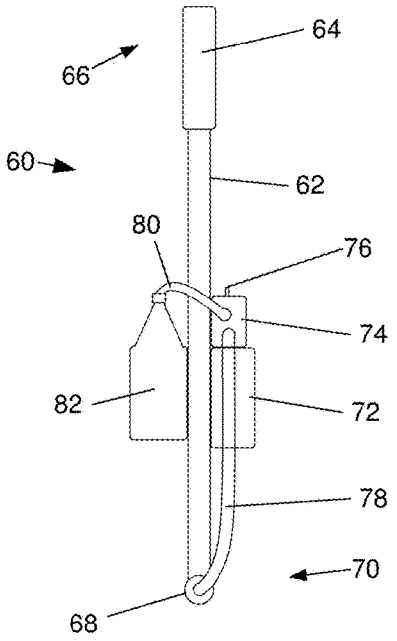
FIG. 4 is a side elevation view of a fluid suction device in accordance with the principles of the invention.
Figure 5:
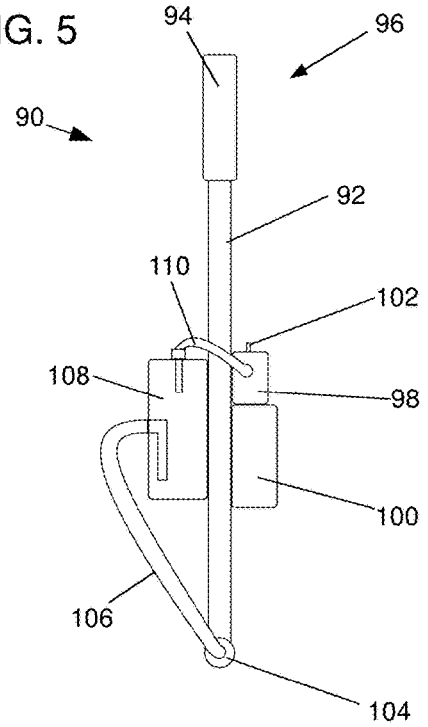
FIG. 5 is a side elevation view of an alternative embodiment of a fluid suction device in accordance with the principles of the invention.

FIGS. 4 and 5 show alternative embodiments of fluid suction devices in accordance with the principles of the invention. They illustrate two possible arrangements for fluid flow through the device. FIG. 4 shows a fluid suction device 60 through which absorbed fluids flow in the same manner as that of device 10 in FIG. 1. A handle 62 is an elongate pole having a sheath 64 to improve gripping at its proximal end 66, and has a cylindrical suction head 68 extending perpendicularly in opposing directions at the distal end 70 of the fluid suction device 60. A battery 72 powers a suction pump 74 having an on/off switch 76. Suction pump 74 applies suction to the suction head 68, thereby wicking liquids through an aperture covered by an absorbent panel as described above. The suction pump 74 pulls fluids through a suction tube 78, through itself and discharge tube 80 and into waste reservoir 82. When the waste reservoir 82 starts to become full, it may be detached and the waste fluid disposed of. In this embodiment, the suction pump 74 is downstream from the section head 68 and upstream of the waste reservoir 82.

FIG. 5 shows an alternative embodiment of a fluid suction device 90 having a handle 92 with a sheath 94 to improve gripping on its proximal end 96. The fluid suction device 90 also includes a suction pump 98 powered by a battery 100 and having an on/off switch 102. When the suction pump 98 is activated, fluid is drawn from the suction head 104 through a discharge tube 106 and is dispensed into a waste reservoir 108. In this embodiment, the waste reservoir 108 is a typical vacuum trap. A suction tube 110 provides suction to the waste reservoir vacuum trap 108. In this embodiment, the waste reservoir 108 is downstream of the suction head 104 and upstream to the suction pump 98.

Figure 6:
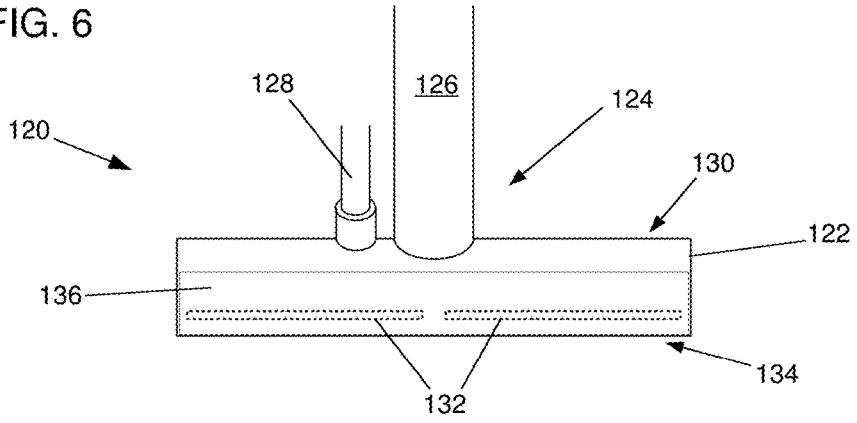
FIG. 6 is a bottom view of an alternative embodiment of a suction head of a fluid suction device in accordance with the principles of the invention.

FIG. 6 shows an alternative embodiment of a suction head 120. The body 122 of the suction head 120 is positioned at the distal end 124 of the handle 126 of a fluid suction device in accordance with the principles of the invention. In this embodiment, the suction tube 128 is attached to the proximal side 130 of the body 122 of the suction head 120. Two longitudinally aligned apertures 132 are located on the distal side 134 of the suction head 120 and are covered by an absorbent panel 136. It may be desirable to utilize one or more apertures 132, which may be arranged in parallel, longitudinal to each other or in other configurations instead of the single aperture configuration shown in FIG. 3.

Figure 7:
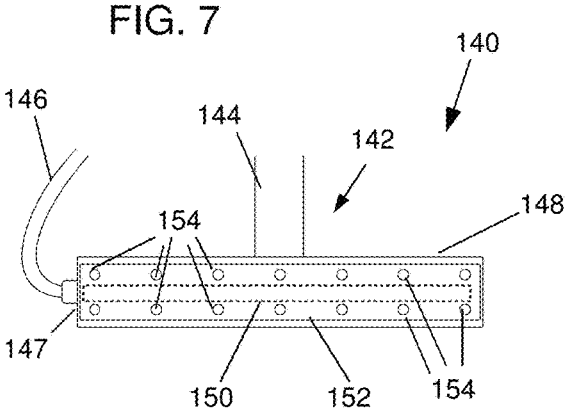
FIG. 7 is a bottom plan view of an alternative embodiment of a suction head of a fluid suction device in accordance with the principles of the invention.

FIG. 7 shows an alternative embodiment of a suction head 140 for use in a fluid suction device in accordance with the principles of the invention. The suction head 140 is affixed to the distal end 142 of a fluid suction device handle 144. A suction tube 146 is attached to the end 147 of the body 148 of the suction head 140. Optionally, the suction tube 146 may be attached at a different location on the suction head 140. The suction head 140 includes a longitudinal aperture 150 extending across the suction head. An absorbent panel 152 is removably attached over the aperture 150 by a plurality of snap buttons 154.

Figure 8:
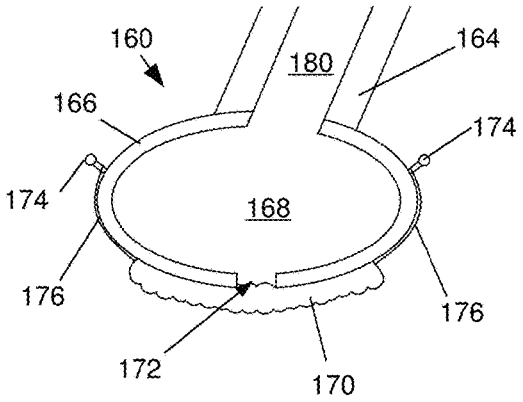
FIG. 8 is a cross-sectional view of an alternative embodiment of a suction head of a fluid suction device in accordance with the principles of the invention.

FIG. 8 shows another alternative embodiment of a suction head 160 for use in a fluid suction device in accordance with the principles of the invention. The suction head 160 is located at the distal end of a fluid suction device handle 164 and has an ellipsoidal outer wall 166 defining and interior chamber 168. In this embodiment, a conduit 180 integrated with in the handle 164 serves as a suction tube to apply suction to the interior chamber 168. An absorbent panel 170 extends across and covers a aperture 172. The suction applied via conduit 180 allows fluids to be wicked through the absorbent panel 170. The panel 170 is held in place by laces 176 stretched over pins 174. Optionally, the suction head may have other geometric configurations. For example, the suction head may have an octagonal cross-section.

Figure 9:
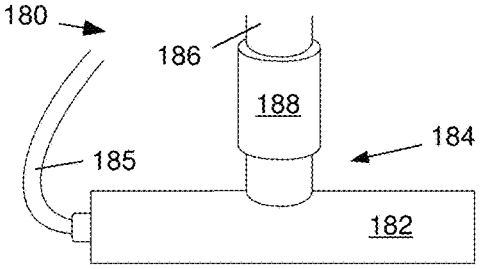
FIG. 9 is a top view of an alternative embodiment of suction head of a fluid suction device in accordance with the principles of the invention.

FIG. 9 shows another alternative embodiment of a fluid suction device 180 having a suction head 182 located at the distal end 184 of a handle 186. A suction tube 185 applies negative air pressure to the suction head. The handle 186 includes a rotatable locking collar 188 that may be used to rotate and lock in place the suction head 182 in different positions relative to the handle 186. Optionally, the collar 188 may be slightly loosened to allow rotation of the suction head 182 during use.

Figure 10:
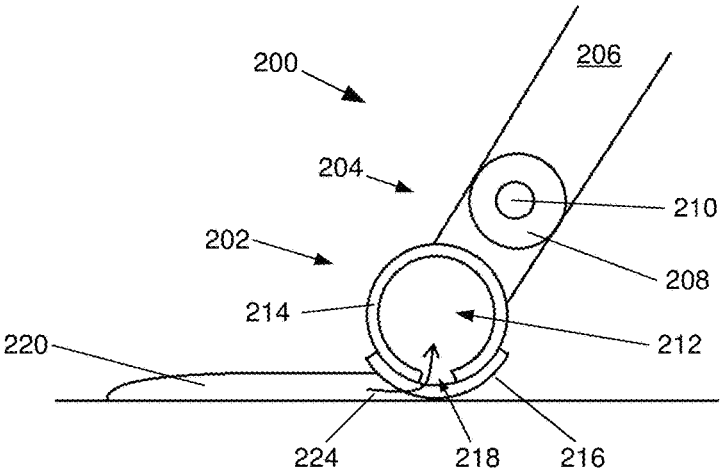
FIG. 10 is a side cross-sectional view of an alternative embodiment of a suction head of a fluid suction device in accordance with the principles of the invention.

FIG. 10 shows another alternative embodiment of a fluid suction device 200 having a suction head 202 located at the distal end 204 of a handle 206. A lockable joint 208 allows the distal end 204 and the suction head 202 to be pivoted and locked at a desired angle about a pivot pin 210. The suction head 202 has an internal chamber 212 defined by an outer wall 214. An absorbent panel 216 is affixed over an aperture 218.

FIG. 10 shows the fluid suction device 200 during use in cleaning spilled fluid 220. Absorbent panel 216 rapidly absorbs liquid. Where panel 216 is comprised of a microfiber material, cotton, or other similar substances, capillary action, cohesive forces and adhesive forces of the fluid material and the panel 216 allow the liquid to be rapidly absorbed by the panel. The fluid within the absorbent panel 216 is efficiently wicked, as shown by directional arrow 224, through the panel 216 and aperture 218 and into interior chamber 212 and eventually to a waste reservoir, not shown. As the suction head is moved over a spilled fluid 220, it rapidly absorbs and collects the fluid. If the spill includes debris such as broken glass or other harmful objects, those objects may be easily pushed into a pile for safer removal after the spill has been removed. Optionally, a cleaning fluid may be applied to a spill area prior to application of a suction head. Once the spilled fluid 220 has been removed and any debris cleared, the fluid suction device 200 may be applied one or more times in conjunction with a cleaning fluid or disinfectant to thoroughly clean and area affected by a spill.

Whereas, the present invention has been described in relation to the drawings attached hereto, it should be understood that other and further modifications, apart from those shown or suggested herein, may be made within the spirit and scope of this invention. Descriptions of the embodiments shown in the drawings should not be construed as limiting or defining the ordinary and plain meanings of the terms of the claims unless such is explicitly indicated.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The invention claimed is:

1. A fluid suction device for removing liquids from a horizontal surface comprising;

a handle comprising an elongate pole;

an elongate cylindrical suction head defined by an outer wall and two ends, wherein the elongate cylindrical suction head is attached to a distal end of the elongate pole at a midpoint of the suction head, and is perpendicular to the elongate pole;

at least one elongate aperture located only on a distal side of the suction head opposite to the elongate pole;

a suction pump affixed to the elongate pole in fluid communication with and applying suction to the aperture of the suction head;

a waste reservoir affixed to the elongate pole and in fluid communication with the suction pump and suction head;

a power supply affixed to the elongate pole and powering the suction pump; and, a replaceable, absorbent wicking panel removably affixed to the outer wall of the suction head extending over and completely covering the at least one aperture of the suction head;

wherein fluid communication between the suction pump and the aperture in the suction head is provided by a discharge tube extending between the suction pump and one of the two ends of the suction head.

2. The fluid suction device of claim 1 wherein the waste reservoir comprises a vacuum trap upstream from the suction pump and configured to collect liquid from the suction head.

3. The fluid suction device of claim 1 further comprising a spray bottle and a spray bottle holster affixed to the elongate pole.

4. The fluid suction device of claim 1 wherein the power supply comprises a rechargeable battery.

5. The fluid suction device of claim 1 wherein the waste reservoir is positioned downstream from the suction pump.

6. The fluid suction device of claim 1 wherein the wicking panel is comprised of a microfiber material and is removably affixed to the outer wall by a hook and loop mechanism.

7. The fluid suction device of claim 1 wherein the at least one aperture comprises two or more apertures on a distal side of the suction head.

8. The fluid suction device of claim 1 wherein the elongate suction head is rigidly affixed to the distal end of the elongate pole and is not rotatable relative to the pole.

* * * * *